US009139411B2

(12) United States Patent
Rider et al.

(10) Patent No.: US 9,139,411 B2
(45) Date of Patent: Sep. 22, 2015

(54) METHOD AND APPARATUS FOR BEVERAGE EXTRACTION WITH A MULTI-FUNCTION VALVE

(71) Applicant: Coravin, LLC, Burlington, MA (US)

(72) Inventors: Mike Rider, Lowell, MA (US); Otto Deruntz, Dunstable, MA (US)

(73) Assignee: Coravin, Inc., Burlington, MA (US)

( * ) Notice: Subject to any disclaimer, the term of this patent is extended or adjusted under 35 U.S.C. 154(b) by 224 days.

(21) Appl. No.: 13/793,415

(22) Filed: Mar. 11, 2013

(65) Prior Publication Data

US 2014/0252046 A1 Sep. 11, 2014

(51) Int. Cl.

| | |
|---|---|
| ***B65D 83/00*** | (2006.01) |
| ***B67D 1/00*** | (2006.01) |
| ***B67D 3/00*** | (2006.01) |
| ***B67D 1/04*** | (2006.01) |

(52) U.S. Cl.

CPC ..... *B67D 1/0004* (2013.01); *B67D 1/0412* (2013.01); *B67D 1/0418* (2013.01); *B67D 3/0048* (2013.01)

(58) Field of Classification Search

CPC ... B67D 1/0004; B67D 1/0412; B67D 1/0418
USPC ..... 222/5, 81–83, 152, 190, 399
See application file for complete search history.

(56) References Cited

U.S. PATENT DOCUMENTS

| | | | |
|---|---|---|---|
| 718,163 | A | 1/1903 | Sherrard |
| 1,509,916 | A | 9/1924 | Waite |
| 2,367,077 | A | 1/1945 | Ward |
| 2,496,258 | A | 2/1950 | Alexander |
| 2,705,578 | A | 4/1955 | Burns |
| 3,191,533 | A | 6/1965 | Vandenberg |
| 3,200,094 | A | 8/1965 | Levinson et al. |
| 3,272,404 | A | 9/1966 | Graves et al. |
| 3,327,899 | A | 6/1967 | Reynolds et al. |
| 3,883,043 | A | 5/1975 | Lane |
| 3,976,221 | A | 8/1976 | Martin et al. |
| 4,011,971 | A | 3/1977 | Haydon |
| 4,143,678 | A | 3/1979 | Sugimura et al. |
| 4,473,174 | A | 9/1984 | Heuser |
| 4,475,576 | A | 10/1984 | Simon |
| 4,595,121 | A | 6/1986 | Schultz |
| 4,674,662 | A | 6/1987 | Bergstrom et al. |
| 4,691,482 | A | 9/1987 | Heinemann et al. |
| 4,694,850 | A | 9/1987 | Fumino |

(Continued)

FOREIGN PATENT DOCUMENTS

| | | | |
|---|---|---|---|
| GB | 2204383 | A | 11/1988 |
| WO | WO 2013011445 | A1 | 1/2013 |

OTHER PUBLICATIONS

International Search Report and Written Opinion dated Jun. 17, 2014 from corresponding PCT Application No. PCT/US2014/020081.

*Primary Examiner* — J. Casimer Jacyna
(74) *Attorney, Agent, or Firm* — Wolf, Greenfield & Sacks, P.C.

(57) ABSTRACT

Devices and methods for extracting a beverage from a container, such as a wine bottle. Beverage can be extracted from a container by inserting a needle through a container closure, such as a cork, delivering pressurized gas into the container via the needle, and dispensing beverage from the container via the needle. A single valve can control flow of gas into the container, flow of beverage from the container, and stop all flow.

17 Claims, 8 Drawing Sheets

(56) References Cited

U.S. PATENT DOCUMENTS

| | | | |
|---|---|---|---|
| 4,706,847 | A | 11/1987 | Sankey et al. |
| 4,850,387 | A | 7/1989 | Bassill |
| 4,856,680 | A | 8/1989 | Sitton |
| 4,867,209 | A | 9/1989 | Santoiemmo |
| 4,932,561 | A | 6/1990 | Boxall |
| 4,976,984 | A | 12/1990 | Yasukawa et al. |
| 4,982,879 | A | 1/1991 | Corrando et al. |
| 4,984,711 | A | 1/1991 | Ellis |
| 5,020,395 | A | 6/1991 | Mackey |
| 5,031,799 | A | 7/1991 | Owen |
| 5,139,179 | A | 8/1992 | Cecil |
| 5,163,909 | A | 11/1992 | Stewart |
| 5,180,081 | A | 1/1993 | McCann |
| 5,395,012 | A | 3/1995 | Grill et al. |
| 5,407,096 | A | 4/1995 | Smith |
| 5,413,230 | A | 5/1995 | Folter et al. |
| 5,413,247 | A | 5/1995 | Glasa |
| 5,590,696 | A | 1/1997 | Phillips et al. |
| 5,947,172 | A | 9/1999 | Glotin |
| 6,371,173 | B1 | 4/2002 | Liebmann, Jr. |
| 6,607,100 | B2 | 8/2003 | Phelps et al. |
| 6,789,698 | B2 | 9/2004 | Gloor et al. |
| 6,843,388 | B1 | 1/2005 | Hollars |
| 7,056,179 | B2 | 6/2006 | Courtney |
| 7,712,637 | B2 | 5/2010 | Lambrecht |
| 8,033,431 | B2 | 10/2011 | Sommerfield et al. |
| 8,225,959 | B2 | 7/2012 | Lambrecht |
| 2011/0016692 | A1 | 1/2011 | Hollars |

METHOD AND APPARATUS FOR BEVERAGE EXTRACTION WITH A MULTI-FUNCTION VALVE

BACKGROUND OF INVENTION

This invention relates generally to the dispensing or other extraction of fluids from within a container, e.g., in the dispensing of wine from a wine bottle.

SUMMARY OF INVENTION

One or more embodiments in accordance with aspects of the invention allow a user to withdraw or otherwise extract a beverage, such as wine, from within a container that is sealed by a cork, plug, elastomeric septum or other closure without removing the closure. In some cases, removal of liquid from such a container may be performed one or more times, yet the closure may remain in place during and after each beverage extraction to maintain a seal for the container. Thus, the beverage may be dispensed from the bottle multiple times and stored for extended periods between each extraction with little or no effect on beverage quality. In some embodiments, little or no gas, such as air, which is reactive with the beverage may be introduced into the container either during or after extraction of beverage from within the container. Thus, in some embodiments, a user may withdraw wine from a wine bottle without removal of, or damage to, the cork, and without allowing air or other potentially damaging gasses or liquids entry into the bottle. However, not all embodiments require the ability to remove an extraction device from a cork or other closure such that the closure reseals the bottle.

In one aspect of the invention, a beverage extraction device includes a base for supporting components of the beverage extraction device, and a body mounted to the base. The body may be movable relative to the base, or be made fixed. At least one needle having at least one lumen may be attached to the body and extend from a proximal end to a distal end. The proximal end of the needle may be mounted to the body, and the needle may be arranged to be inserted through a closure at an opening of a beverage container with movement of the body relative to the closure. For example, the body and needle may be moved relative to the base, which may be clamped or otherwise engaged with the container, so that the needle is inserted through the closure. A gas source may be mounted to the body, be fluidly coupled to the needle and arranged to deliver pressurized gas to the at least one lumen at the proximal end of the needle. A valve may be fluidly coupled to the gas source and the at least one needle, and have a control portion that is movable between three flow states including a gas flow state, a beverage flow state and an off state. In the gas flow state, the valve permits gas flow from the gas source to the at least one needle and prevents flow of beverage out of the container via the at least one needle. In the beverage flow state, the valve prevents gas flow from the gas source to the at least one needle and permits flow of beverage out of the container via the at least one needle, e.g., to a beverage outlet on the body. In the off state, the valve prevents gas flow from the gas source to the at least one needle and prevents flow of beverage out of the container via the at least one needle.

In some embodiments, the control portion may be movable along a linear path between the three flow states, e.g., a lever movably mounted to the body may be used to move the control portion between the three flow states. The valve may include a spring that biases the control portion to move to the beverage flow state, e.g., so that the user may dispense beverage without touching the valve. The control portion of the valve may be movable linearly from the beverage flow state, to the off state, and then to the gas on state, allowing for easy operation of the valve by a user.

The device may include a pair of clamp arms mounted to the base and movable relative to each other to clamp a beverage container neck and support the base on the beverage container. For example, the clamp arms may be spring biased to clamp a bottle neck, and/or may include a locking mechanism to lock the arms in engagement with the neck. The body may be movably mounted to the base such that movement of the body relative to the base moves the needle relative to the base. This may be convenient when inserting the needle through a cork or other closure since the base may be clamped to the bottle.

The gas source may include a compressed gas cylinder and a regulator to regulate a pressure of gas provided to the at least one needle. Thus, when the valve is put into the gas on state, gas may be provided to the container interior, but at a regulated pressure so the user does not need to control gas input closely. As noted above, the at least one needle may include a single needle arranged for insertion through a cork of a wine bottle, for delivery of gas into the wine bottle, and for delivery of wine from the bottle.

The valve may include a valve body with a stepped inner surface, and the control portion may include a spool with a plurality of seals arranged to interact with the stepped inner surface of the valve body to control flow through the valve. For example, the stepped inner surface may include a first section having a first diameter, a third section having a third diameter, and a second section between the first and third sections and having a second diameter. The first diameter may be larger than the second and third diameters, and the second diameter may be larger than the third diameter. The control portion may include first, second and third seal elements arranged to contact and form a seal with each of the first, second and third sections, respectively. Thus, by moving the control element, the seals may engage/disengage with respect to a respective section of the valve, controlling flow in the valve. In one arrangement, a gas port may be in fluid communication with the first section, and a needle port may be in fluid communication with the second section so that the second seal element controls flow between the gas port and the needle port.

In another aspect of the invention, a method for extracting wine from a wine bottle includes inserting at least one needle through a closure at an opening of a beverage container, operating a valve into a gas flow state in which the valve permits flow of gas from a pressurized gas source through the at least one needle and into the wine bottle, operating the valve into a wine flow state in which flow of gas through the at least one needle is stopped and wine flows from the bottle through the at least one needle and to a beverage outlet, and operating the valve into an off state in which flow of gas through the at least one needle is stopped and flow of wine from the bottle through the at least one needle is stopped.

As noted above, the needle may be arranged for insertion through a cork of a wine bottle and for delivery of a gas into the wine bottle, and/or for delivery of wine from the bottle. For example, the system may include a gas source, such as a compressed gas cylinder, fluidly coupled to the needle and arranged to deliver pressurized gas to the at least one lumen at the proximal end of the needle. Delivery of gas to the container may allow beverage to be extracted from the container, e.g., by having the pressurized gas drive beverage to exit through a lumen of the needle, or otherwise allow beverage to flow from the container.

The needle may be arranged to be used with closures that include a material capable of resealing upon withdrawal of the needle from the closure. For example, typical wine bottle corks may allow a needle to be passed through the cork to extract wine from the bottle, and then reseal upon removal of the needle such that gas and/or liquid are prevented from passing through the cork after needle removal.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
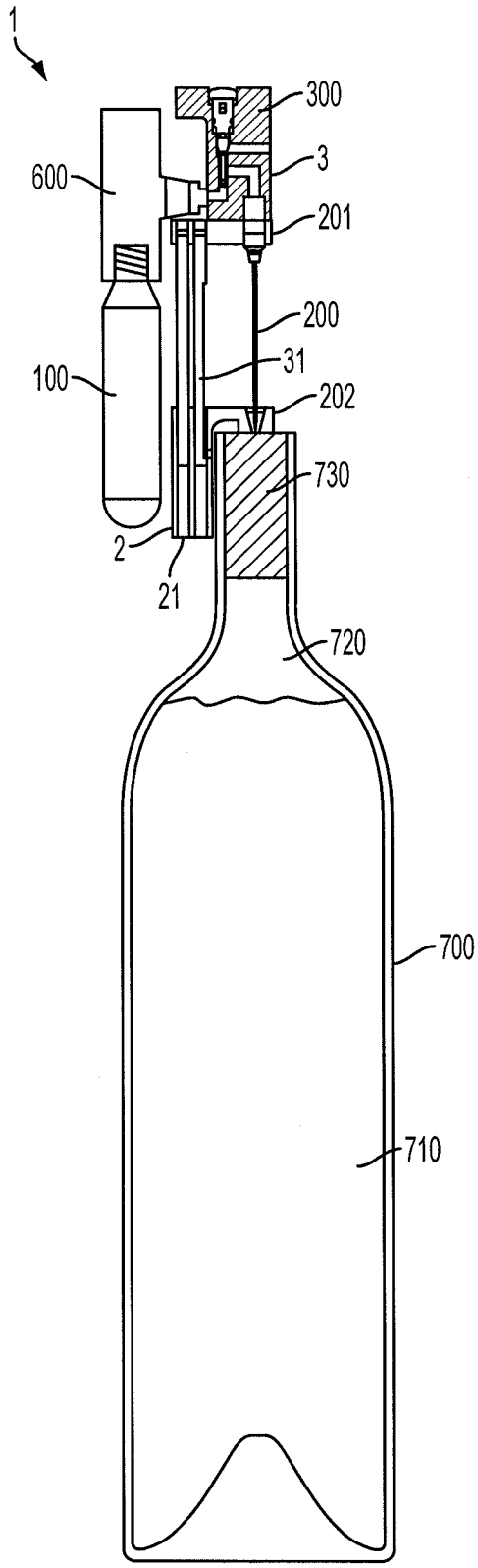
FIG. 1 shows a sectional side view of a beverage extraction device in preparation for introducing a needle through a closure of a beverage container.

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device 1 that may incorporate one or more aspects of the invention. This illustrative system 1 includes a body 3 with an attached pressurized source of gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. No. 4,867,209; U.S. Pat. No. 5,020,395; and U.S. Pat. No. 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the container 700 (such as a wine bottle), e.g., so that a pressure established inside the container 700 does not exceed a desired level, such as a level that ensures the closure 730 will not be expelled.

In this embodiment, the body 3 also includes a valve 300 operable to control the flow of gas from the regulator 600. The valve 300 may be a 3-way toggle valve that includes a single operation button and functions to selectively introduce pressurized gas into the container 700 and extract beverage 710 (such as wine) from the container 700 via a needle 200. Details regarding the operation of such a valve 300 are provided in U.S. Pat. No. 8,225,959, which is incorporated by reference in its entirety. However, other valve arrangements for controlling pressurized gas and beverage flow are possible, including those described below and which incorporate aspects of the invention.

To introduce gas into the container 700 and extract beverage, a needle 200 attached to the body 3 is inserted through a cork or other closure 730 that seals an opening of the container 700. This illustrative system 1 uses a pencil-tip non-coring needle 200 with a needle opening 220 along a sidewall of the needle near the needle tip. While the needle 200 may be inserted into the cork or other closure 730 in different ways, in this embodiment, the system 1 includes a base 2 with a pair of channels 21 that receive and guide movement of respective rails 31 of the body 3. Thus, movement of the body 3 and attached needle 200 relative to the container closure 730 may be guided by the base 2, e.g., the body 3 may slide relative to the base 2 to move the needle 200 into/out of the closure 730. In addition, movement of the needle 200 may be guided by a needle guide 202 that is attached to the base 2 and positioned over the closure 730. Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others. In yet other embodiments, the body 3 need not be movable relative to the base 2, but may be fixed to each other. In this case, needle insertion may be performed by moving the body and base together relative to the container.

In some embodiments, the base 2 may be fixed or otherwise held in place relative to the container 700, e.g., by a clamp, sleeve, strap or other device that engages with the container 700. Clamp arrangements may be used to temporarily or releasably secure the device 1 to a wine bottle neck or other container 700. By restraining movement of the base 2 relative to the container 700, such an arrangement may help guide motion of a needle 200 relative to the container 700 when penetrating a closure 730, or when being withdrawn from the closure 730. Alternately, the container 700 may be manipulated by grasping and manipulating the device 1 since the clamp engaging the device 1 to the container 700 may securely hold the device 1 and container 700 together.

Figure 2:
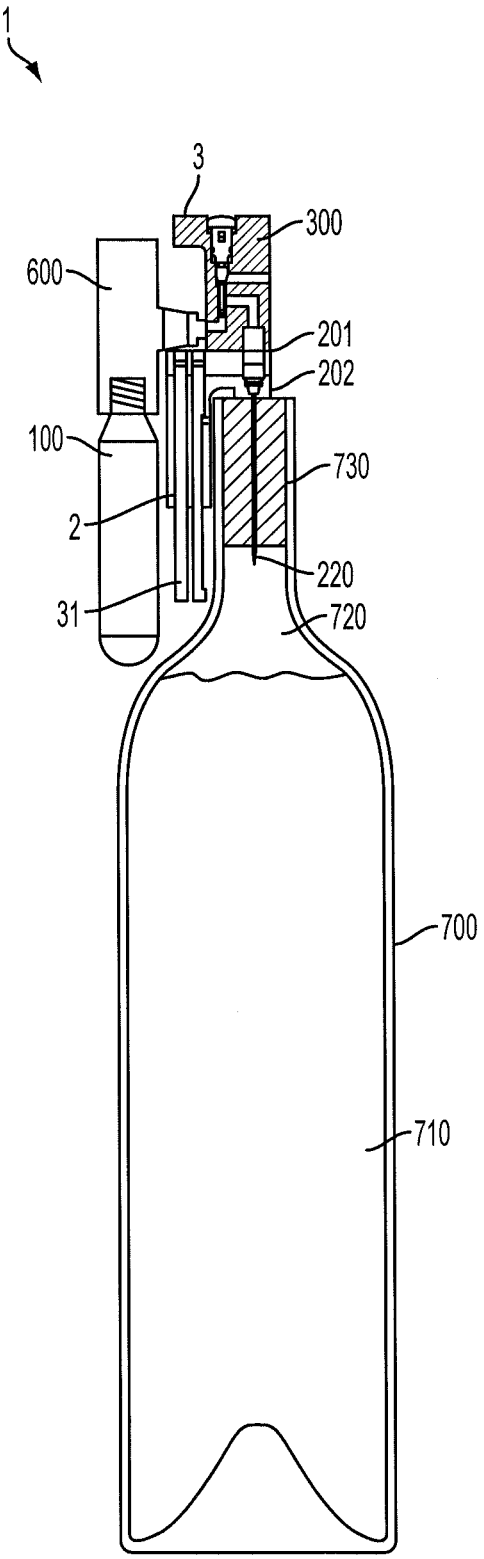
FIG. 2 shows the FIG. 1 embodiment with the needle passed through the closure.
Figure 3:
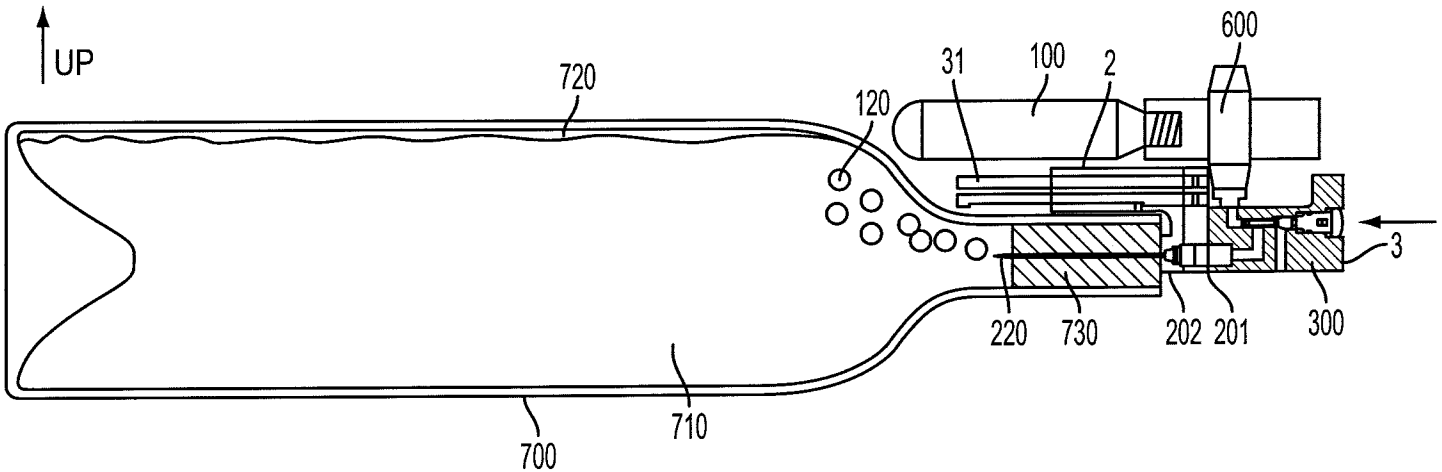
FIG. 3 shows the FIG. 1 embodiment while introducing gas into the container.
Figure 4:
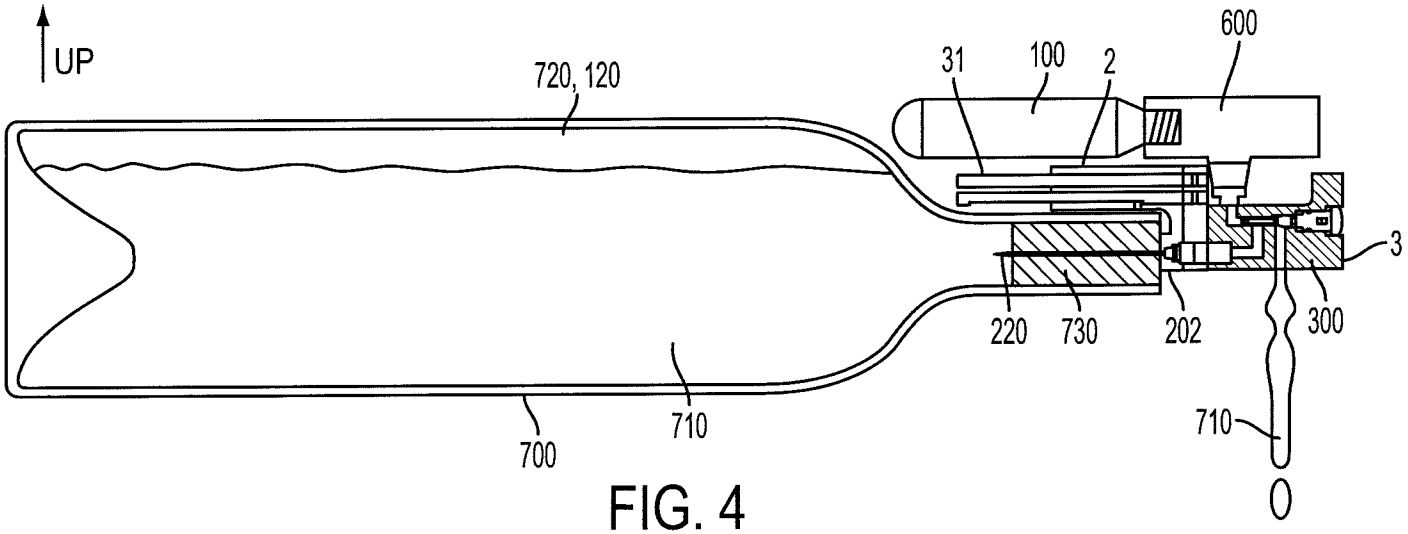
FIG. 4 shows the FIG. 1 embodiment while dispensing beverage from the container.

To insert the needle 200 through the closure 730, a user may push downwardly on the body 3 while maintaining the base 2 and the container 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the container 700. The container 700 may then be tilted, e.g., so that the beverage 710 flows to near the closure 730 and any air or other gas 720 in the container 700 flows away from the closure. Pressurized gas 120 may then be introduced into the container 700 by actuating the valve 300 and causing gas from the cylinder 100 to flow through the valve 300 and needle 200 to exit at the needle opening 220, as shown in FIG. 3. Thereafter, the valve 300 may be operated to stop the flow of pressurized gas and allow beverage 710 to flow into the needle opening 220 and through the needle 200 to be dispensed from the valve 300, as shown in FIG. 4.

Figure 5:
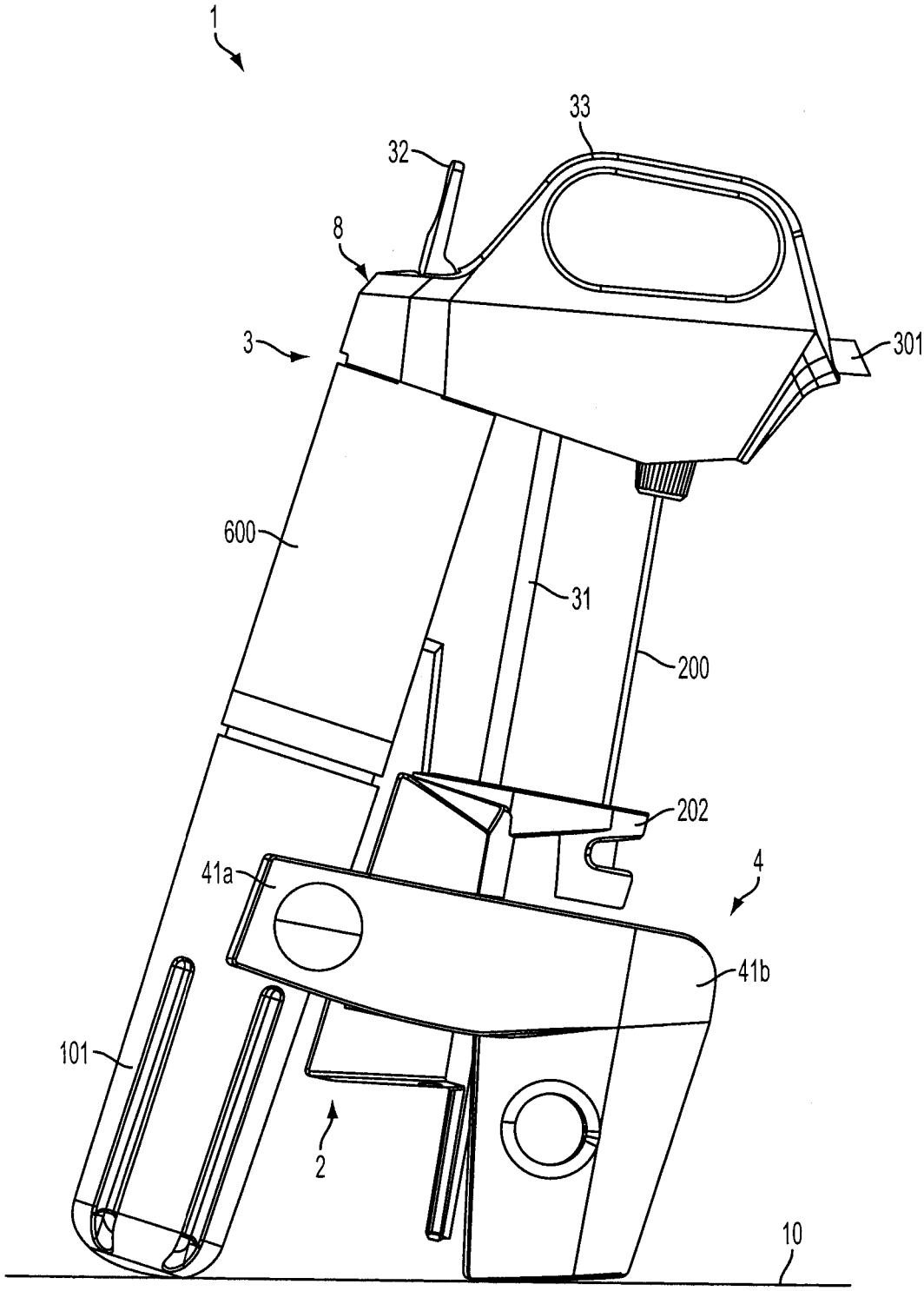
FIG. 5 shows a side view of a beverage extraction device having a clamp arrangement for supporting the device in an upright orientation in an illustrative embodiment.
Figure 6:
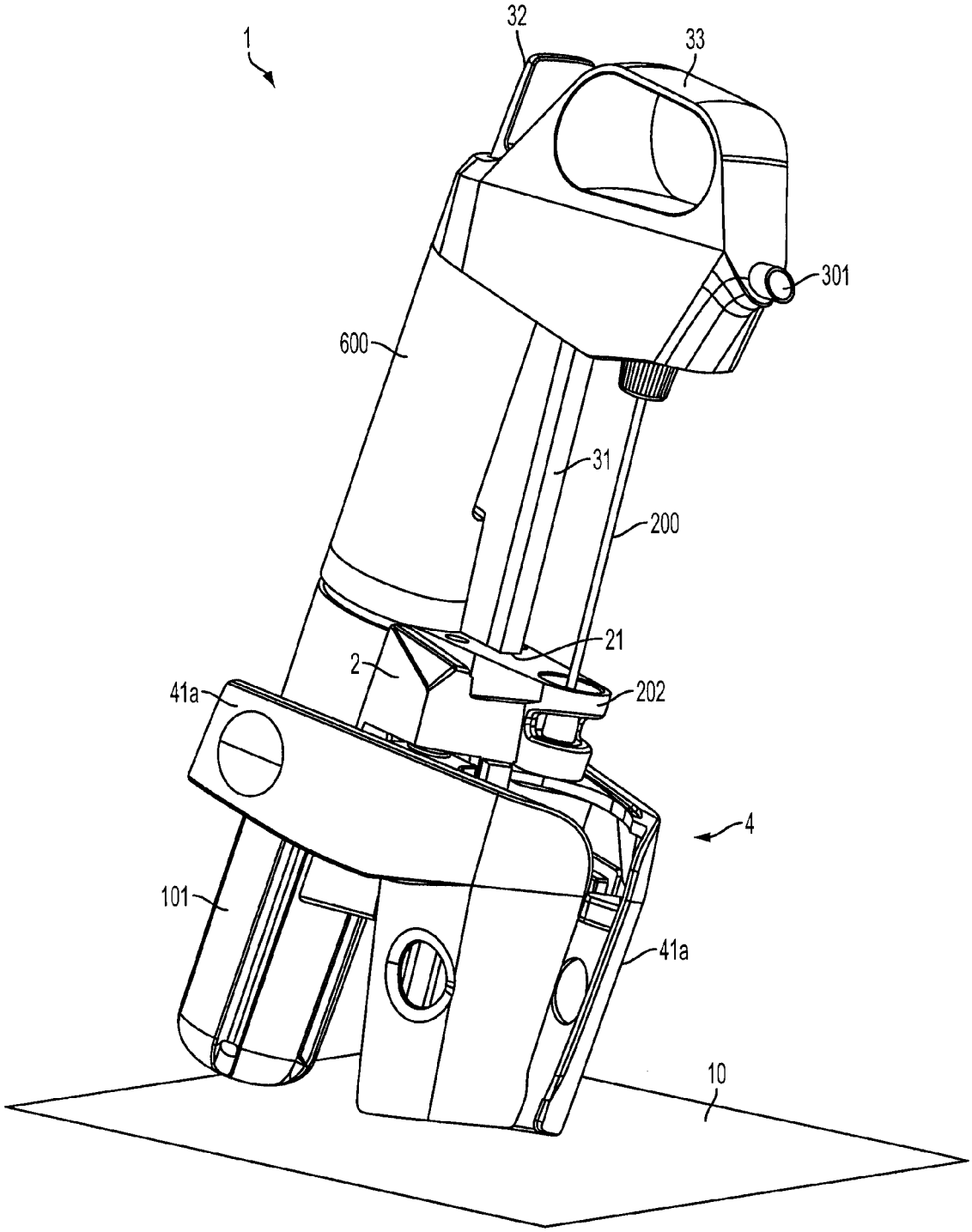
FIG. 6 shows a front perspective view of the FIG. 5 embodiment.
Figure 7:
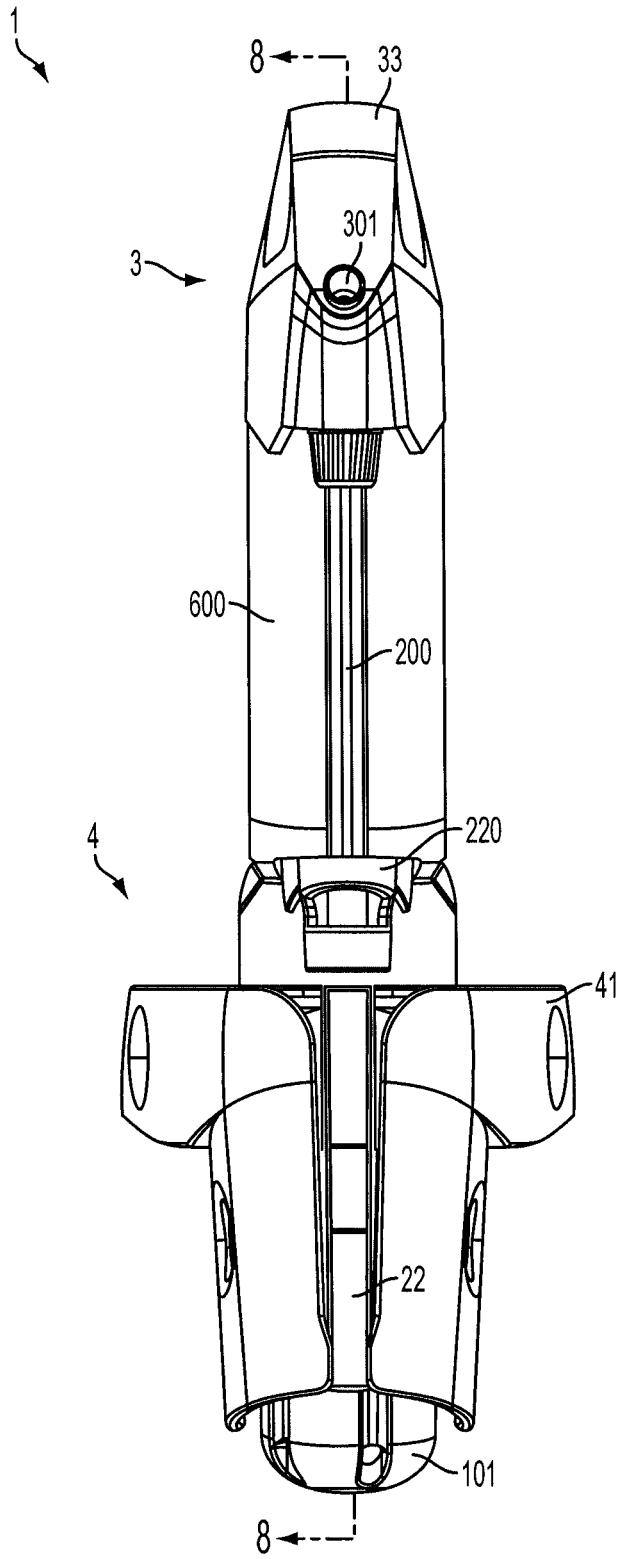
FIG. 7 shows a front view of the FIG. 5 embodiment.

FIGS. 5-7 show a illustrative embodiment of a beverage extraction device 1 that incorporates aspects of the invention. This embodiment is similar in operation to that of FIGS. 1-4, but has a few different features including a valve for controlling gas and beverage flow described in detail below. In this embodiment, the body 3 includes a handle 33, that may be gripped by a user for moving the body 3 relative to the base 2 in upward and downward motions to insert a needle 200 through a cork or other closure of a container 700. Also, a lever 32 is provided for operating the valve 8, e.g., to dispense beverage from an outlet 301 and/or deliver gas to the container 700 via the needle 200. To allow movement of the body 3 relative to the base 2, the body 3 includes a rail 31 that has T-shaped cross section, and is arranged to move within a T-shaped receiving slot or channel 21 of the base 2. As discussed above, however, other arrangements are possible for engaging the body 3 and base 2 while allowing for movement of the needle 200. Also, a gas cylinder cover 101 threadedly engages with the body 3 at the regulator 600 to engage and hold the cylinder 100 in place relative to the body 3. (A gas cylinder cover 101 in this embodiment is a kind of cap that covers the gas cylinder 100 and threadedly engages with another part of the body 3 to hold the gas cylinder 100 in place.) This arrangement of a gas cylinder cover 101 allows for the use of gas cylinders 100 that do not threadedly engage with the regulator 600, but rather are held in engagement with the regulator 600 by the cover 101.

Also included in this embodiment is a clamp 4 having a pair of clamp arms 41 that are arranged to support the device 1 in an upright orientation on a flat, horizontal surface 10, such as a table or counter top. In this embodiment, a lowermost portion of the clamp arms 41 contacts the surface 10 along with a lowermost portion of the body 3, which in this example is a lower end of gas cylinder cover 101. Thus, the clamp arms 41 and cover 101 may provide three points of contact with the surface 10, although additional points of contact may be provided. Note that in this embodiment, the lowermost portions of the clamp arms 41 that contact the surface 10 are located proximally, relatively near the cover 101, and the lower surfaces of the clamp arms 41 form an angle with the surface 10 such that distal ends of the lower surfaces are uplifted from the surface 10. This arrangement may help prevent tipping of the device 1 forward. For example, if the device 1 is contacted while standing upright so that the device 1 begins to tip forward, the lower surfaces of the clamp arms 41 may contact the surface 10 and help arrest movement of the device 1 and complete tipping over. Also, the cover 101 need not contact the surface 10, and instead other portions of the body 3 or the base 2 may contact the surface 10 to support the device 1 in an upright orientation. In another arrangement, the clamp arms 41 alone may contact the surface 10 and support the device 1. For example, the clamp arms 41 may include "feet" or other structure that contacts the surface 10 to suitably support the device 1 without assistance from other parts of the device 1.

In this embodiment, the clamp arms 41 are arranged to support the device 1 in an upright orientation when the body 3 is in an uppermost position relative to the base 2, i.e., when the body 3 is moved upwardly as far as possible relative to the base 2. However, the clamp arms 41 may be arranged to support the device 1 in the upright orientation for other positions of the body 3 relative to the base 2, such as for upper positions of the body 3 relative to the base 2 (where the body 3 is positioned in an upper half of its range of movement relative to the base 2) or for any suitable position of the body 3 relative to the base 2. Thus, the clamp arms 41 may be arranged to help hold the device 1 in an upright position when the body 3 is in two or more positions relative to the base 2.

In accordance with an aspect of the invention, a single valve may be operable to control flow of gas to the needle, and control flow of beverage from the needle to the beverage outlet. In one embodiment, the valve may have three flow states:

- a gas flow state in which the valve permits gas flow from the gas source to the one needle and prevents flow of beverage out of the container via the at least one needle,
- a beverage flow state in which the valve prevents gas flow from the gas source to the needle and permits flow of beverage out of the container via the needle, and
- an off state in which the valve prevents gas flow from the gas source to the needle and prevents flow of beverage out of the container via the needle.

This type of arrangement can allow for convenient operation of a beverage extraction device, particularly where the device has a single operation lever, knob or other component to control the valve. For example, with operation of a single element, a user can charge a wine bottle with a pressurized gas, then operate the lever to dispense wine from the bottle, followed by preventing both flow of wine and pressurization when a glass of wine has been dispensed. Thus, a user can dispense a desired amount of wine while avoiding further pressurization of the bottle and possible "sputtering" that may occur if the user attempts to turn the bottle upright during dispensing and residual pressure in the bottle vents, taking any remaining wine in the device with the vented gas. Also, the off state may be positioned between the gas flow and beverage flow states so that a user can conveniently stop the flow of gas or wine with reduced risk of releasing gas or causing beverage flow.

In one embodiment, the valve may include a control portion that moves along a linear path to control flow of gas and beverage. Such an arrangement may make for simplified operation and assembly of the valve, as well as provide for more reliable operation. In one embodiment, the valve body may include a stepped inner surface with three sections having different diameters. The control portion may have three seal elements, such as an o-ring, that each contact and form a seal with a respective section of the stepped inner surface. This arrangement may provide for a higher tolerance for manufacturing variation than other valve constructions, such as those that have a stepped inner surface with two working sections. For example, the stepped inner surface in one embodiment may accommodate for variations in distance between seal elements on the control portion, allowing for the use of a plastic material or other less creep-resistant or deformation resistant material.

Figure 8:
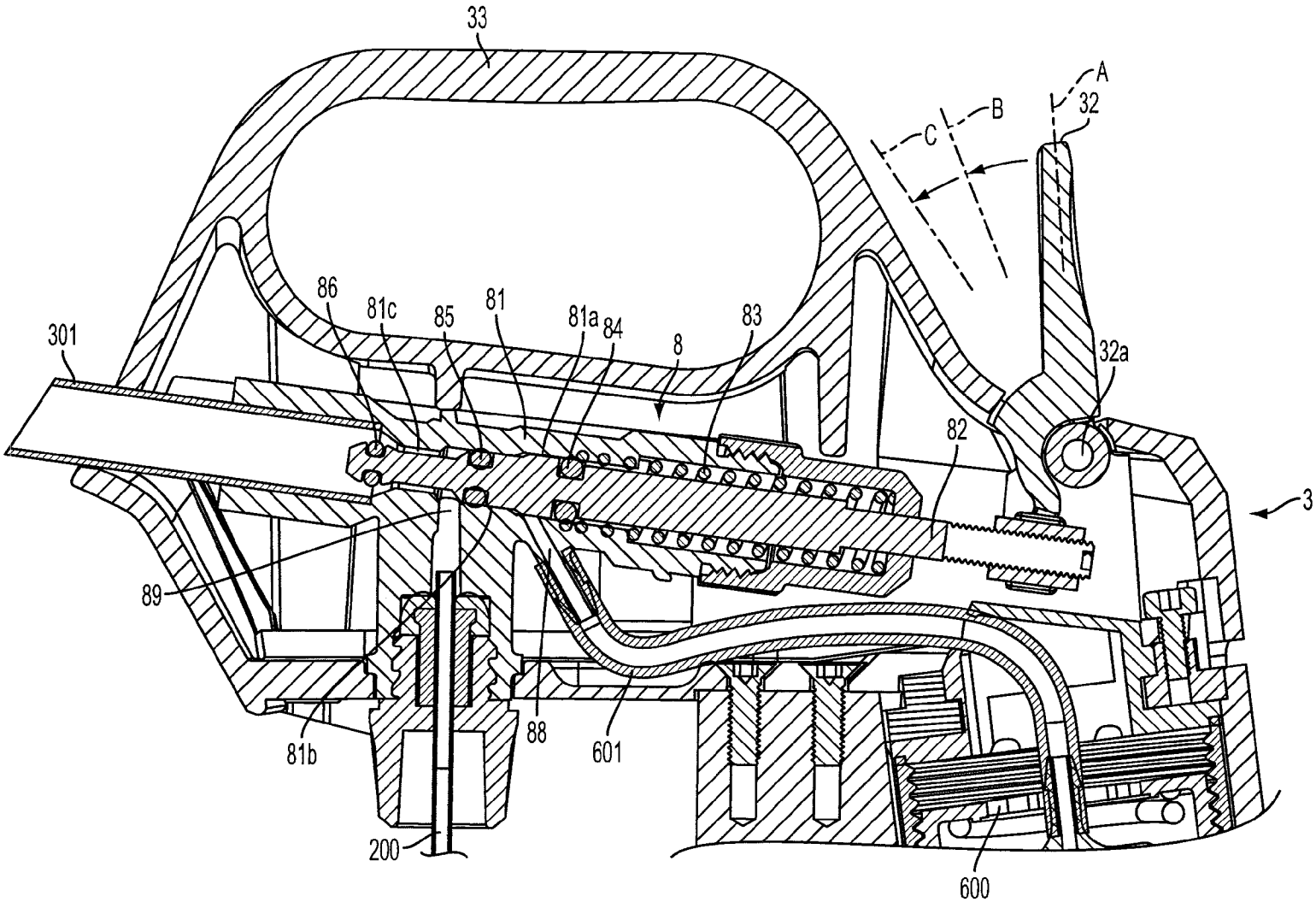
FIG. 8 shows a cross-sectional view along the line 8-8 in FIG. 7.

FIG. 8 shows a cross-sectional view of a valve 8 of a beverage extraction device 1 that incorporates aspects of the invention. In this embodiment, the valve 8 is operated by a lever 32 which is pivotally mounted to the body 3 by a pivot pin 32*a*. Thus, an operator can move the lever 32, e.g., between positions A, B, and C as shown, to move the control portion 82 in the valve body 81, thereby switching the valve 8 between flow states. In this embodiment, position A of the lever corresponds to a beverage flow state, position B corresponds to an off state, and position C corresponds to a gas flow state. By having the off state position located between the gas flow and beverage flow states, a user can easily stop beverage or gas flow and with minimal risk of causing unwanted beverage or gas flow. Although not shown, the lever 32 may include a detent, indicator or other device to indicate when the lever 32 is moved between, or to, one of the positions A, B, or C. For example, a detent may operate to keep the lever 32 at any one (or all) of the positions A, B or C when released. Thus, a user may place the valve 8 in a flow state and the detent may retain the valve in that state until the user moves the lever 32. Alternately, the detent may operate to keep the lever only at the off position B and/or the beverage flow position A, but not the gas flow position C. This way, the device 1 cannot be left dispensing gas when not in use. In another embodiment, a "clicker" element (such as a resilient finger made of plastic or metal) may move and create a clicking or snapping sound when the lever 32 is moved between positions. As a result, the user may be provided with an audible indication of valve flow state change. Also, although in this embodiment a lever 32 is provided for user interaction to control the valve 8, other arrangements are possible, such as one or more push buttons, a trigger positioned within the handle 33 (e.g., as found in many firearms), an electrically-controlled valve actuator (such as a solenoid), a thumb wheel and associated gear drive, etc.

In this embodiment, the valve body 81 includes a stepped inner surface with a first section 81*a*, a second section 81*b*, and a third section 81*c*. These sections 81*a*-81*c* are working sections in that they contact and form a seal with a seal element on the control portion 82 to control flow. The first section 81*a* has a larger diameter than the second section 81*b* and the third section 81*c*, and the second section has a larger diameter than the third section 81*c*. A gas port 88 is in fluid communication with the first section 81*a* and with a gas supply line 601, which is connected to the regulator 600. Thus, the gas port 88 can provide pressurized gas to the valve 8 at the first section 81*a*. A needle port 89 is in fluid communication with the second section 81*b* and with the needle 200, and thus the needle port 89 can conduct gas flow from the valve 8 to the needle 200, and conduct flow of wine or other beverage from the needle 200 to the valve 8.

Although in this embodiment, a single needle 200 is used to provide pressurized gas to the container 700 and to conduct beverage from the container 700, two or more needles may be used, and the needles may be arranged to carry only gas flow or beverage flow. For example, in one embodiment, two needles may be used and fluidly coupled to the needle port 89. However, one needle may include a check valve in its flow path from the needle port 89 that only permits flow into the container (i.e., for gas flow), whereas the other needle may include a check valve that only permits flow out of the container (i.e., for beverage flow). Thus, the valve 8 shown in FIG. 8 can be used with a dual or multi-needle embodiment. In other embodiments, however, the valve 8 could be modified to operate with dual needle arrangements that have no check valves. Instead, the valve 8 could control flow in the needles as desired. For example, the second section 81*b* could be elongated and arranged so that a gas needle port is provided along with a beverage needle port. The control portion 82 could include two seal elements that interact with the second section 81*b*, and one seal element may be positioned between the two needle ports, whereas the other seal element may be positioned between the gas port and the first section 81*a* like that in FIG. 8. Accordingly, the valve 8 could be operated to provide gas flow to the gas needle port, but the additional seal element would prevent gas flow to the beverage needle port. As in the FIG. 8 embodiment, the third seal element 86 may control flow of beverage from the beverage needle port.

When moving between flow states, the control portion 82, which has a spool configuration, slides along a linear path in the valve body 81. A spring 83 biases the control portion 82 to move to the left as shown in FIG. 8 such that with the lever 32 released, the control portion 82 is biased to move to the beverage flow state with the lever 32 in the beverage flow position A. That is, with the lever 32 in the beverage flow position A as shown in FIG. 8, a second seal element 85 forms a seal with the second section 81*b* of the inner surface of the valve body 81 so that flow between the gas port 88 and the needle port 89 is blocked. Also, a third seal element 86 is positioned out of contact with the third section 81*c*, allowing flow between the needle port 89 and the beverage outlet 301. Thus, with the lever 32 in the beverage flow position A, the valve 8 permits beverage to exit the container 700. (A first seal element 84 forms a seal with the first portion 81*a* for all control portion 82 positions such that flow from the gas port 88 out of the valve body 81 to the right as shown in FIG. 8 is always prevented.)

Upon movement of the lever 32 from the position A to the off position B, the control portion 82 slides to the right in FIG. 8 such that the third seal element 86 contacts the third section 81*c* and forms a seal that prevents flow between the needle port 89 and the beverage outlet 301. Also, the second seal 85 remains in contact with the second section 81*b*, preventing flow between the gas port 88 and the needle port 89. Thus, all flow in and out of the needle port 89 and out of the gas port 88 is prevented with the control portion 82 in the off state.

Further movement of the lever 32 from the off position B to the gas flow position C causes the second seal element 85 to move to the right such that the seal element 85 enters the first section 81*a* and loses contact with the second section 81*b*. As a result, flow between the gas port 88 and the needle port 89 is opened, allowing pressurized gas to flow from the gas source (regulator 600 and cylinder 100) into the container 700 via the needle 200. Although the third seal element 86 moves to the right in the third section 81*c*, the third seal element 86 maintains contact with the third portion 81*c* when the lever is in the gas flow position C (and the control portion 82 is in the gas flow state), preventing flow from the needle port 89 to the beverage outlet 301. Complete release of the lever 32 by a user allows the spring 83 to bias the control portion 82 to move to the left as shown in FIG. 8, returning the control portion 82 to the beverage flow state and the lever 32 to the beverage flow position A.

A user may therefore operate the device to dispense a beverage, such as wine from a corked wine bottle, by first inserting at least one needle through a cork or other closure at an opening of a beverage container. As described above, this may involve clamping the extraction device to the neck of the wine bottle, and pushing down on the device body to insert the needle(s) through the cork. Next, the device valve may be moved to a gas flow state in which the valve permits flow of gas from a pressurized gas source, such as a gas cylinder and regulator, through the needle(s) and into the wine bottle. In the example above, this may be done by moving the lever 32 to the gas flow position C.

With the bottle suitably pressurized, the valve may be operated (e.g., moved) into a wine flow state in which flow of gas through the needle(s) is stopped and wine flows from the bottle, through the needle(s) and to a beverage outlet of the device. Again, in the example above, this may be done by moving the lever 32 to the beverage flow position A. Since the valve is moved from the gas flow position C to the off position B prior to achieving the beverage flow position A, release of gas from the bottle may be reduced, e.g., as the user tilts the bottle to pour the wine into a glass, since flow from both the gas port and the needle port is blocked as the valve shifts between flow states.

After a desired amount of wine is dispensed, the valve may be operated into the off state in which both flow of gas through the needle(s) and flow of wine from the bottle through the needle(s) is stopped. For example, while pouring wine into a glass, the user may press the lever 32 to the off position B, stopping wine flow into the glass when desired. The user may then turn the bottle upright and release the lever 32, which allows the valve to move to the beverage flow state and vent any gas pressure in the bottle. Alternately, the valve 8 may remain in the off state, trapping gas pressure in the bottle until the user purposefully vents the bottle.

It has been found that needles having a smooth walled exterior, pencil point or Huber point needle of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the container and any remaining beverage to be stored for months or years without abnormal alteration of the beverage flavor. Further, such needles may be used to penetrate a foil cover or other wrapping commonly found on wine bottles and other containers. Thus, the needle may penetrate the foil cover or other element as well as the closure, eliminating any need to remove the foil or other wrapping prior to beverage extraction. Other needle profiles and gauges are also usable with the system.

While in the above embodiments the needle guide 202 and needle are positioned to have the needle penetrate the center of the closure 730, the lower opening or through hole of the guide 202 could be arranged to introduce the needle at a location offset from the center of cork 730. This may decrease the chances that a needle penetrates the closure 730 in a same location if the system 1 is used to dispense beverage from the container several times and may allow the closure 730 to better reseal upon needle withdrawal.

While in the above embodiments, a user moves the body 3 in a linear fashion relative to the base 2 to insert/remove a needle with respect to a container closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source.

A needle used in a beverage extraction device may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip.

With the correct needle gauge, it has been found that a passageway (if any) that remains following removal of the needle from a cork self-seals against egress or ingress of fluids and/or gasses under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 17 and 20 gauge. These needles gauges may offer optimal fluid flow with minimal pressures inside the container while doing an acceptably low level of damage to the cork even after repeated insertions and extractions.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. The needle may be fluidly connected to the valve directly through any standard fitting (e.g. NPT, RPT, Leur, quick-connect or standard thread), via a custom fitting or thread arrangement, or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas containers filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiment above, a single needle with a single lumen is used to introduce gas into the container and extract beverage from the container. However, in other embodiments two or more needles may be used, e.g., one needle for gas delivery and one needle for beverage extraction. In such an embodiment, the valve may operate to simultaneously open a flow of gas to the container and open a flow of beverage from the container. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Multiples of these components could be combined into single parts or components serving multiple functions. For example, the needle guide may be made part of a container clamp.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A beverage extraction device, comprising:

a base for supporting components of the beverage extraction device;

a body mounted to the base;

at least one needle having at least one lumen extending from a proximal end to a distal end, the proximal end of the needle being mounted to the body, the at least one needle being arranged to be inserted through a closure at an opening of a beverage container with movement of the body relative to the closure;

a gas source mounted to the body, fluidly coupled to the needle and arranged to deliver pressurized gas to the at least one lumen at the proximal end of the at least one needle; and a valve fluidly coupled to the gas source and the at least one needle, the valve having a control portion movable along a linear path between three flow states including a gas flow state in which the valve permits gas flow from the gas source to the at least one needle and prevents flow of beverage out of the container via the at least one needle, a beverage flow state in which the valve prevents gas flow from the gas source to the at least one needle and permits flow of beverage out of the container via the at least one needle, and an off state in which the valve prevents gas flow from the gas source to the at least one needle and prevents flow of beverage out of the container via the at least one needle, the valve including a spring that biases the control portion to move to the beverage flow state, and wherein the control portion is movable linearly against a bias of the spring from the beverage flow state, to the off state, and then to the gas on state.

2. The device of claim 1, further comprising a lever movably mounted to the body and movable to move the control portion between the three flow states.

3. The device of claim 1, further comprising a beverage outlet in fluid communication with the at least one needle such that the valve is operable to control flow between the at least one needle and the beverage outlet.

4. The device of claim 1, further comprising:

a pair of clamp arms mounted to the base and movable relative to each other to clamp a beverage container neck and support the base on the beverage container.

5. The device of claim 1, wherein the body is movably mounted to the base such that movement of the body relative to the base moves the needle relative to the base.

6. The device of claim 1, wherein the gas source includes a compressed gas cylinder and a regulator to regulate a pressure of gas provided to the at least one needle.

7. The device of claim 1, wherein the at least one needle is arranged for insertion through a cork of a wine bottle and for delivery of gas into the wine bottle.

8. The device of claim 1, wherein the at least one needle is arranged for insertion through a cork of a wine bottle and for delivery of wine from the bottle.

9. The device of claim 1, wherein the at least one needle includes a single needle arranged for insertion through a cork of a wine bottle, for delivery of gas into the wine bottle, and for delivery of wine from the bottle.

10. The device of claim 1, wherein the valve includes a valve body with a stepped inner surface and the control portion includes a spool with a plurality of seals arranged to interact with the stepped inner surface of the valve body to control flow through the valve.

11. The device of claim 10, wherein the stepped inner surface includes a first section having a first diameter, a third section having a third diameter, and a second section between the first and third sections and having a second diameter, the first diameter being larger than the second and third diameters, and the second diameter being larger than the third diameter.

12. The device of claim 11, wherein the spool includes first, second and third seal elements arranged to contact and form a seal with each of the first, second and third sections, respectively.

13. The device of claim 12, further comprising a gas port in fluid communication with the first section and the gas source, and a needle port in fluid communication with the second section and the at least one needle.

14. The device of claim 13, wherein the second seal element controls flow between the gas port and the needle port.

15. A method for extracting wine from a wine bottle, comprising:

inserting at least one needle through a closure at an opening of a beverage container;

moving a valve control portion along a linear path against a spring bias from a wine flow state to an off state and then to a gas flow state in which the valve permits flow of gas from a pressurized gas source through the at least one needle and into the wine bottle;

moving the valve control portion along the linear path from the gas flow state to the off state and then to the wine flow state in which flow of gas through the at least one needle is stopped and wine flows from the bottle, through the at least one needle and to a beverage outlet; and moving the valve control portion along the linear path to the off state in which flow of gas through the at least one needle is stopped and flow of wine from the bottle through the at least one needle is stopped.

16. The method of claim 15, wherein the steps of operating the valve include positioning a lever of a beverage extraction device at a position that corresponds to the respective valve state.

17. The method of claim 16, further comprising:

releasing the lever to allow the lever to move under the spring bias to the wine flow state.

* * * * *